US007654111B2

(12) United States Patent
Alley et al.

(10) Patent No.: US 7,654,111 B2
(45) Date of Patent: Feb. 2, 2010

(54) RING PROTECTOR

(76) Inventors: Rob Alley, 6318 9th Ave. NE., Seattle, WA (US) 98115; Kristy Alley, 6318 9th Ave. NE., Seattle, WA (US) 98115

( * ) Notice: Subject to any disclaimer, the term of this patent is extended or adjusted under 35 U.S.C. 154(b) by 406 days.

(21) Appl. No.: 11/613,747

(22) Filed: Dec. 20, 2006

(65) Prior Publication Data

US 2008/0148776 A1 Jun. 26, 2008

(51) Int. Cl.
*A44C 9/00* (2006.01)

(52) U.S. Cl. ..... 63/15.8

(58) Field of Classification Search ..... None
See application file for complete search history.

(56) References Cited

U.S. PATENT DOCUMENTS 1,533,441 A * 4/1925 Melling ..... 63/15.8
1,885,930 A * 11/1932 Lowy ..... 63/15.8
2,048,317 A 7/1936 Berman
4,377,079 A 3/1983 Krueger
D364,830 S 12/1995 Roemer
D377,769 S 2/1997 Roemer
D455,098 S 4/2002 Stefanelli

* cited by examiner

*Primary Examiner*—Jack W. Lavinder
(74) *Attorney, Agent, or Firm*—Darby & Darby P.C.; Patrick R. Turner

(57) ABSTRACT

Ring protector made from an elastic material and including a safety mesh. Ring protectors made according to principles of this invention protect rings from damage while at the same time keeping them on the wearers finger and avoiding slippage during active endeavors such as swimming.

20 Claims, 3 Drawing Sheets

RING PROTECTOR

FIELD OF THE INVENTION

This invention relates to apparel, more specifically, to a ring protector and for methods of protecting a person's ring or rings during active conduct.

BACKGROUND OF THE INVENTION

Typically, an individual's most valuable piece of jewelry (both in terms of sentimental and monetary value) is a ring. Like most jewelry of significant monetary or sentimental value, rings are kept throughout a person's life and are often worn during active conduct. Rings are typically sized to fit a person's finger at the time of purchase or at the time of other acquisition. Throughout the course of a person's life, ring size for a particular finger may change for a variety of reasons. A ring may be incorrectly sized for the wearer's finger or it may become incorrectly sized due to natural changes in finger size.

Some forms of active conduct, including swimming in cold water, may cause a finger to be reduced in size. Further, some individuals may experience weight loss after being sized for a ring. Weight loss may cause a smaller ring size. When a ring is sized too large for the wearer's finger, there exists substantial risk for the ring to become lost, especially during active conduct. Further, when a ring is sized too large for a wearer's finger, there exists substantial risk that the ring could oscillate or move upon the finger in a way that could cause injury.

Rings often include gems that protrude away from the body of the ring. In many cases, gems make up the most valuable portion of the ring, both in terms of sentimental and monetary value. A protruding gem is typically affixed to the body of the ring through conventional mechanical means known to skilled jewelers. The quality or nature of the workmanship used to mount a gem may place it at risk of becoming lost. Poorly mounted gems could become dislodged from even minimal impact. If the wearer of a ring with a gem engages in active conduct, the gem is at further risk of becoming dislodged. Further, if the ring is poorly fit to the wearer's finger, the gem may move about during active conduct, causing risk of injury to the wearer or others.

In view of the foregoing, there exists a need for a ring protector that may be worn by an individual in order to protect the ring and gem from being lost, especially during active conduct. Further, there exists a need for a ring protector that can be used to reduce movement of the ring on the wearer's finger and consequently reduce the risk of injury to the wearer or others during active conduct.

SUMMARY OF THE INVENTION

The invention presents a ring protector for protecting a ring worn upon a finger of a user, the ring protector comprising: a protective band at least partially formed from an elastic material adapted to stretch to an expanded configuration to permit a user to pass the protective band over the ring and to contract to a contracted configuration wherein the protective band encircles the ring to protect the ring and to aid in holding the ring upon the finger.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
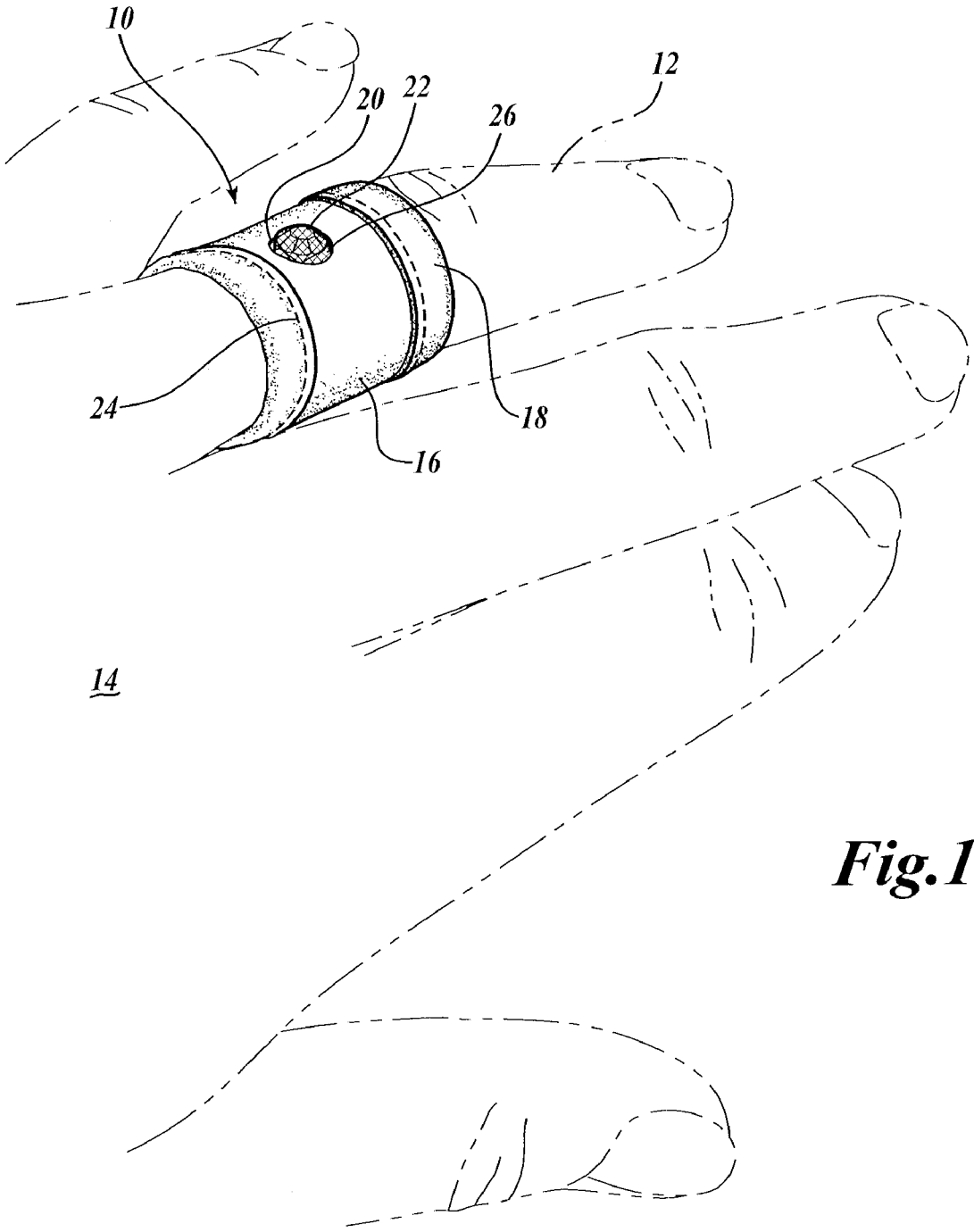
FIG. 1 shows one embodiment of a ring protector made according to principles of the invention.

FIG. 1 shows one embodiment of a ring protector (10) made according to principles of the invention. The ring protector (10) may be worn on a finger (12) of a hand (14) when that hand is wearing a ring (28). Ring protector (10) has an interior protective band (16) and exterior protective bands (18). As depicted, the exterior protective bands (18) are disposed on opposite sides of the interior protective band (16). The exterior protective bands (18) thus define the length (15) of ring protector (10) and the protective surface area (13). As depicted, ring protector (10) may be of a length (15) extending from just below first knuckle (11) and just above second knuckle (17). Alternatively, length (15) may be such that exterior bands (18) are closer together, thus defining a smaller protective surface area (13). Alternatively, exterior protective bands (18) may be farther apart from one another, such that the interior protective band (16) covers first knuckle (11) of second knuckle (17). One of skill in the art will appreciate that the exterior protective bands (18) may be of a variety of configurations and structure and still define protective surface area (13). As depicted, exterior protective bands (18) circle the finger (12) forming one continuous loop.

With continuing reference to FIG. 1, the interior protective band (16) may form one continuous loop around finger (12). It is important to note that interior protective band (16) need not form a continuous loop around finger (12), it may only partially encircle finger (12). As depicted, interior protective band (16) includes a stone recess (20). Stone recess (20) is sized to receive stone (22). Stone recess (20) may be of a circular configuration but the invention is by no means limited to such a configuration. One of skill in the art will readily appreciate that the stone recess (20) could take on a variety of shapes in order to function as described and claimed herein. As depicted in FIG. 1, stone recess (20) is sized smaller relative to stone (22) such that stone recess (20) may function to at least partially retain stone (22) on the finger. Stone recess (20) also functions to at least partially display the gemstone on the finger (12).

As depicted, stone recess (20) may also be equipped with a safety mesh (26). Safety mesh (26) may be formed from a variety of commercially available mesh products such as 75D polyester mosquito net or 40D Nylon Nylex Print. Safety mesh (26) need not be a "mesh" in the literal sense of the word, any material capable of being affixed to interior protective band (16) and sufficient to retain stone (22) within the stone recess (20) will suffice as safety mesh (26).

Figure 2:
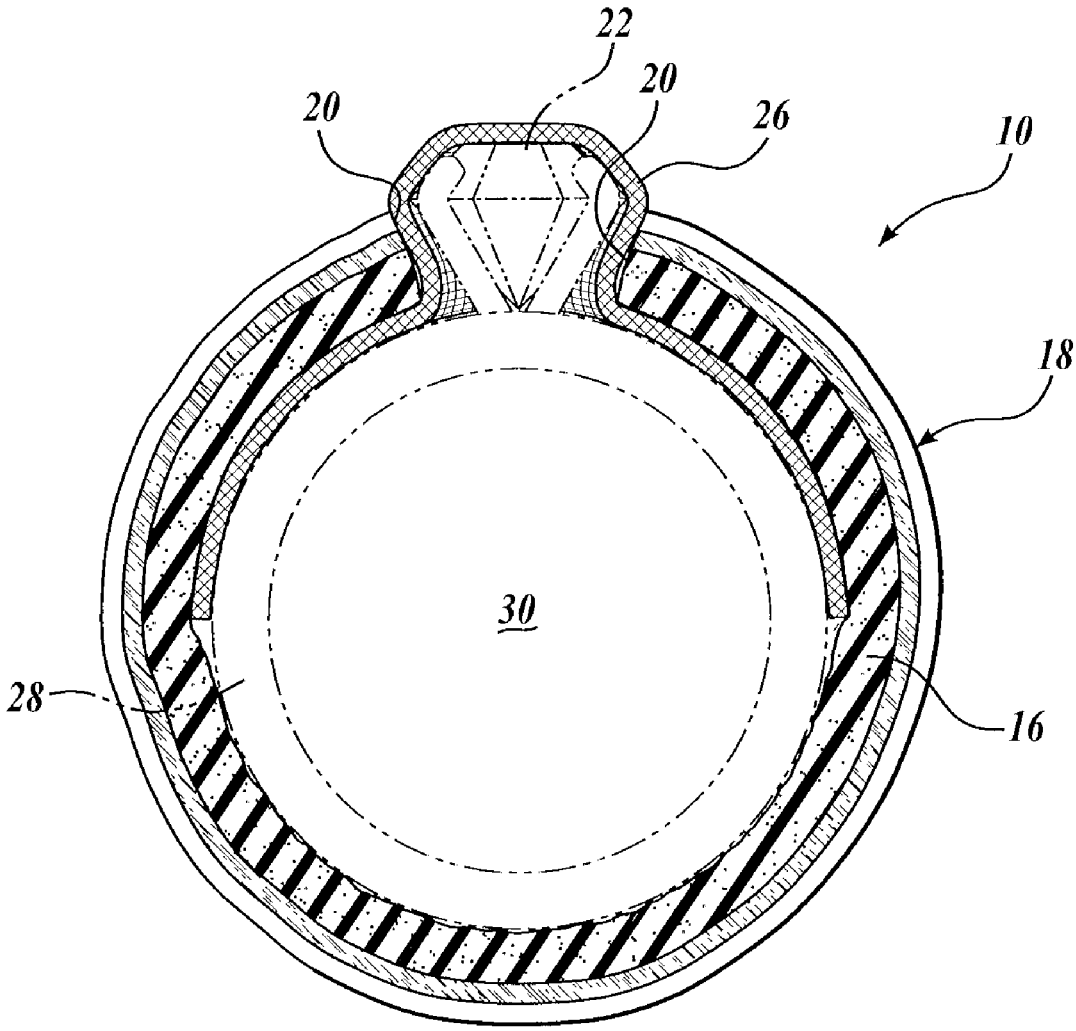
FIG. 2 is a cross-sectional, schematic view of a ring protector constructed according to principles of the invention.

As best seen in FIG. 2, the ring protector (10) may be constructed from a variety of layered materials. Shown in cross section, interior protective band (16) may be comprised of two layers, an internal layer (19) and an external layer (21). Internal layer (19) may be a padded layer constructed from conventional padding materials. Interior layer (19) is preferably soft, providing a comfortable fit over finger (30). The inside diameter (23) of interior layer (19) is preferably sized smaller than the outside diameter of finger (30) such that interior padded layer may stretch-to-fit finger (30). Sizing interior diameter (23) to stretch over finger (30) permits the ring protector (10) to adequately support the ring on finger (30).

With continuing reference to FIG. 2, safety mesh (26) is affixed to the inside diameter (23) of interior padded layer (16). Safety mesh (26) may be affixed to the interior padded layer (16) by a variety of conventional means, including glue. Alternatively, interior safety mesh (26) may be sewn into the inside diameter (23) of interior padded layer (16). Safety mesh (26) is of a sufficient length to provide a recessed area (20) within which to restrain stone (22). Mesh (26) may be comprised of any material sufficient to flex and retain stone (22) within recessed area (20). As shown in this particular embodiment, safety mesh (26) is a synthetic mesh material having mesh openings of no larger than 0.01 mm. As stated above, a variety of mesh materials may be usable within the spirit and principals of this invention. The invention is by no means limited to any particular mesh product for the safety mesh (26).

With continuing reference to FIG. 2, exterior layer (21) is comprised of a flexible, preferably water-resistant material. Exterior layer (19) can be formed from a variety of polymer materials commonly used for active conduct including water sports. Exterior layer (16) may also be of a material that is suitable for printing and any material that will hold color after multiple uses in water.

Figure 3:
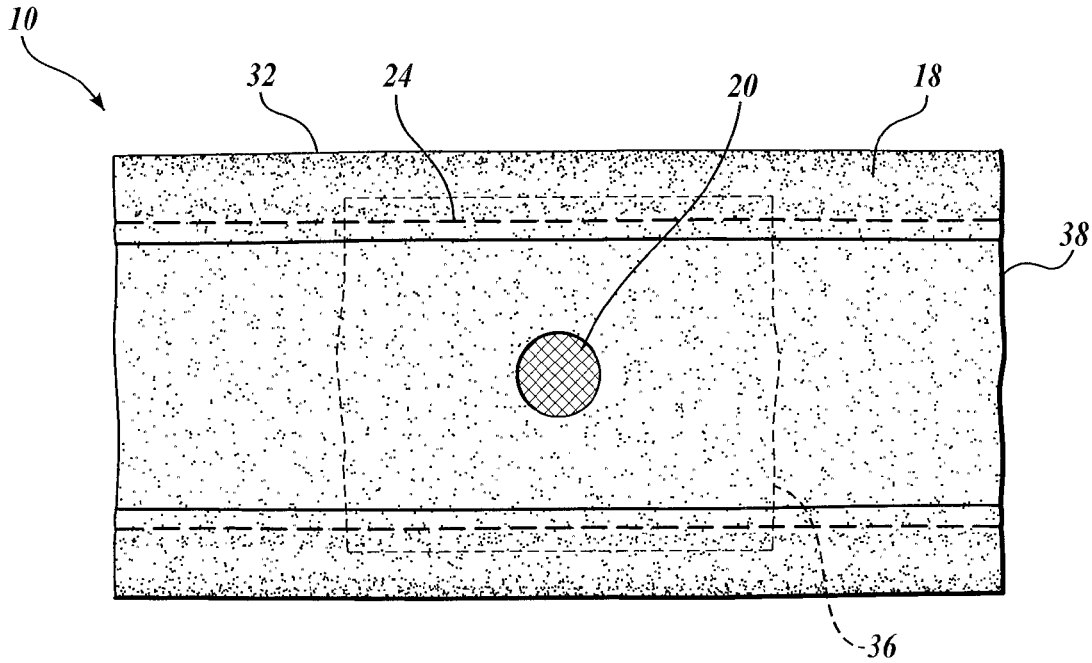
FIG. 3 is a partial, schematic, top view of a ring protector constructed according to principles of the invention.
Figure 4:
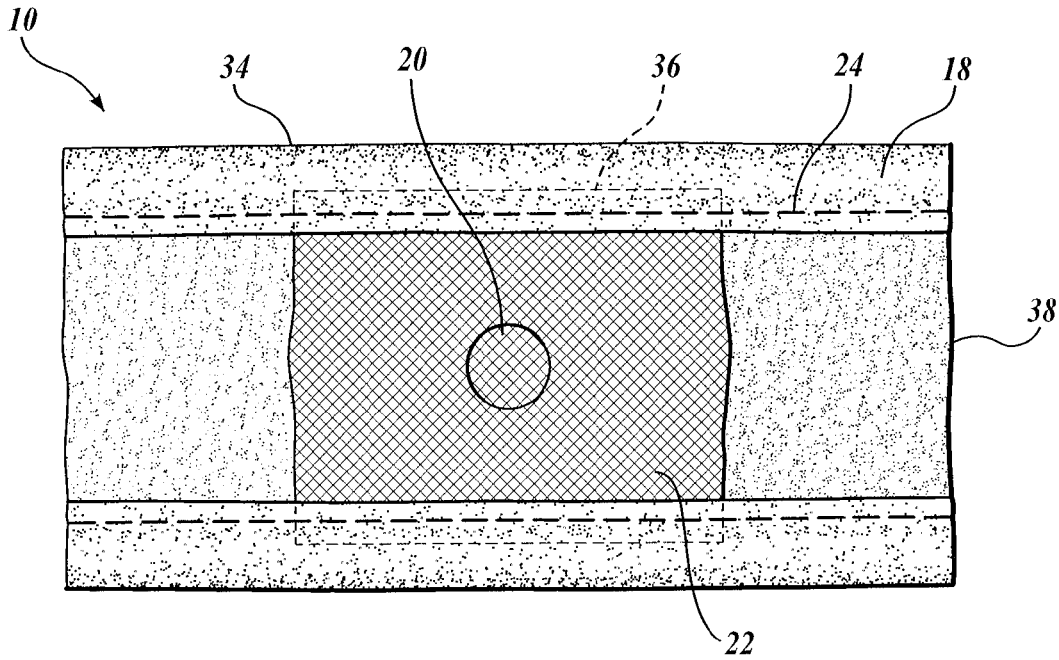
FIG. 4 is a partial, schematic, underside view of a ring protector constructed according to principles of the invention.

With reference now to FIGS. 3 and 4, the ring protector (10) is displayed. FIG. 3 shows the stone recess (20) and the underlying safety mesh (26). The edge of safety mesh (26) is shown in phantom as element (36). FIG. 3 also shows a permissible location for the closing seam (38). As depicted in FIGS. 3 and 4, the ring protector (10) may be constructed using machine or hand sewing conventional techniques. FIG. 3 shows an exterior seam (24) that may be sewn along the edge of exterior protective band (18). As seen best in FIG. 4, safety mesh (26) is sewn underneath exterior protective band (18) by way of exterior seam (24). Exterior protective band (18) is long enough to cover the edge of safety mesh (26) as seen in broken lines (36). As best shown in FIG. 4, safety mesh (26) has a sufficient surface area to be secured to the rear of the ring protector (34) underneath exterior protective band (18) along the exterior seam (24).

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A ring protector for protecting a ring worn upon a finger of a user, the ring protector comprising:

a protective band at least partially formed from an elastic material adapted to stretch to an expanded configuration to permit a user to pass the protective band over the ring and to contract to a contracted configuration, wherein the protective band encircles the ring to protect the ring and to aid in holding the ring upon the finger; and a safety mesh coupled to a recess disposed in the protective band to at least partially house a stone attached to the ring.

2. The ring protector of claim 1, wherein the recess is sized such that the recess is smaller than the stone attached to the ring, and wherein the safety mesh further includes a flexible material that extends through the recess in the protective band to at least partially and conformably house the stone attached to the ring.

3. The ring protector of claim 1, further including an at least partially translucent panel coupled to the protective band for permitting the user to at least partially view the ring through the at least partially translucent panel when the ring protector is in the contracted configuration.

4. The ring protector of claim 1, wherein the protective band is a continuous non-separable band absent of a fastening assembly for permitting adjacent ends of the protective band to be separated from one another during donning and then reattached to one another during use.

5. The ring protector of claim 1, wherein the protective band is adapted, when in the contracted configuration, to engage a top surface of the ring without substantially engaging either side of the ring or a bottom surface of the ring.

6. The ring protector of claim 1, wherein the protective band is adapted to continuously apply a compression force radially inward upon a portion of the finger disposed adjacent the ring when the protective band is in the contracted configuration to aid in retaining the ring upon the finger.

7. The ring protector of claim 1, wherein the protective band is cylindrical in shape and has a predetermined width which exceeds a width of the ring, and wherein the protective band is adapted to continuously apply a compression force radial inward upon a portion of the finger disposed adjacent the ring when the protective band is in the contracted configuration to aid in retaining the ring upon the finger.

8. The ring protector of claim 1, wherein the protective band is cylindrical in shape.

9. The ring protector of claim 1, wherein the protective band is cylindrical in shape and has a width which is about a half inch or greater such that the protective band extends outward from the ring in a direction parallel with a length of the finger to engage the ring and a portion of the finger adjacent the ring.

10. The ring protector of claim 1, wherein the protective band is made from a neoprene material.

11. A ring protector for protecting a ring worn upon a finger of a user, the ring protector comprising:

a protective band adapted to be worn about an outer surface of a ring worn upon a finger of a user to encircle the ring and hold the ring upon the finger, the protective band having a predetermined width selected to exceed a width of the ring such that the protective band engages the portion of the finger disposed adjacent the ring, and wherein at least a portion of the protective band is made from an elastic material for applying a compression force upon a portion of the finger disposed adjacent the ring, the compression force directed radially inward about a circumference of the finger to aid in holding the ring upon the finger; and a safety mesh coupled to a recess disposed in the protective band to at least partially house a stone attached to the ring.

12. The ring protector of claim 11, wherein the recess in the protective band is configured such that the stone projects beyond an outside diameter of the protective band, and wherein the recess further includes an opening that defines a perimeter of the recess in the protective band to at least partially define the housing for the stone attached to the ring.

13. The ring protector of claim 11, further including an at least partial translucent panel coupled to the protective band permitting the user to at least partially view the ring through the at least partially translucent panel when the ring protector is in the contracted configuration.

14. The ring protector of claim 11, wherein the protective band is a continuous band absent of a fastening assembly for permitting adjacent ends of the protective band to be separated from one another during donning and then reattached to one another during use.

15. The ring protector of claim 11, wherein the protective band is adapted, when in the contracted configuration, to engage a top surface of the ring without substantially engaging either side of the ring or a bottom surface of the ring.

16. The ring protector of claim 11, wherein the protective band is cylindrical in shape and has a width which is about a half inch or greater.

17. The ring protector of claim 11, wherein the protective band is made from a neoprene material.

18. A ring protector for protecting a ring worn upon a finger of a user, the ring protector comprising:

(a) a protective band adapted to be worn about an outer surface of a ring worn upon a finger of a user to encircle the ring and hold the ring upon the finger, wherein the protective band has a predetermined width selected to exceed a width of the ring such that the protective band engages a portion of the finger disposed adjacent the ring, and wherein at least a portion of the protective band is made from an elastic material adapted to apply a compression force upon the portion of the finger disposed adjacent the ring, the compression force directed radially inward about a circumference of the finger to aid in holding the ring upon the finger;

(b) a safety mesh coupled to a recess disposed in the protective band to at least partially house a stone attached to the ring;

(c) an at least partially translucent panel coupled to the protective band permitting the user to at least partially view the ring through the at least partially translucent panel when the ring protector is in the contracted configuration; and (d) wherein the protective band is a continuous band absent of a fastening assembly for permitting adjacent ends of the protective band to be separated from one another during donning and then reattached to one another during use.

19. The ring protector of claim 18, wherein the protective band is adapted, when in the contracted configuration, to engage a top surface of the ring without substantially engaging either side of the ring or a bottom surface of the ring.

20. The ring protector of claim 18, wherein the protective band is cylindrical in shape and has a width which is about a half inch or greater.

* * * * *